US005524332A

United States Patent [19]

Krause

[11] Patent Number: 5,524,332

[45] Date of Patent: Jun. 11, 1996

[54] WIPER ASSEMBLY FOR ELECTRICAL CONNECTOR CODING STATION

[75] Inventor: Hans G. Krause, St. Charles, Ill.

[73] Assignee: Molex Incorporated, Lisle, Ill.

[21] Appl. No.: 340,984

[22] Filed: Nov. 17, 1994

[51] Int. Cl.[6] ..... H01R 43/18

[52] U.S. Cl. ..... 29/564.7; 29/566.3; 83/145

[58] Field of Search ..... 29/33 M, 564.7, 29/564.8, 566.3, 566.1, 748, 749; 83/111, 145

[56] References Cited

U.S. PATENT DOCUMENTS 3,664,218 5/1972 Lau et al. ..... 83/111 X 4,275,495 6/1981 Boutcher, Jr. ..... 29/749

4,434,551 3/1984 Holt ..... 29/749

*Primary Examiner*—William Briggs

*Attorney, Agent, or Firm*—Charles S. Cohen

[57] ABSTRACT

An improved coding station for a wire harness processing machine includes a wiper assembly mounted alignment with a reciprocating knife assembly. The knife assembly has a plurality of individual cutoff blades which reciprocate in a cutting action to sever coding lugs formed on electrical connectors. The wiper assembly includes a wiper arm which extends out from a base portion to a location spaced apart from a cutoff anvil so that it contacts outer surfaces of the cutoff blades to provide an edge which wipes severed coding lugs from the cutoff blade outer surfaces.

19 Claims, 6 Drawing Sheets

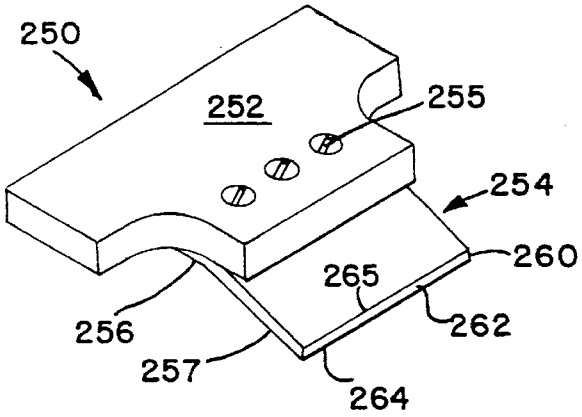
FIG. 6
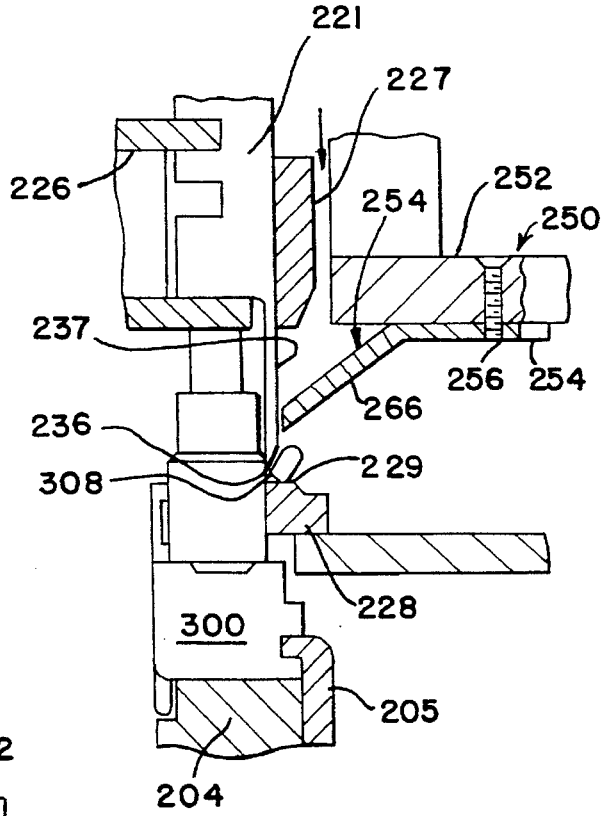
FIG. 7
FIG. 8
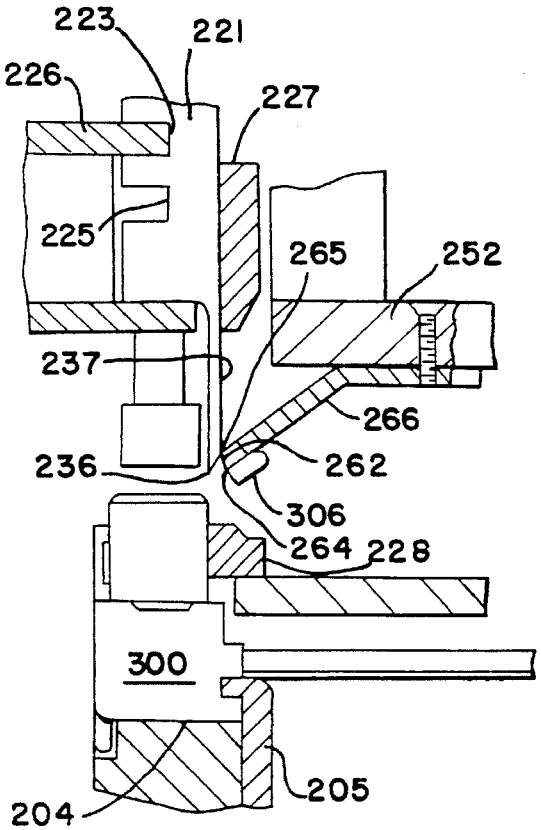

WIPER ASSEMBLY FOR ELECTRICAL CONNECTOR CODING STATION

BACKGROUND OF THE INVENTION

The present invention relates generally to the fabrication of wire harnesses and, more particularly to the coding or keying of the electrical connectors which are terminated to wires in a wire harness.

Wire harnesses are commonly used in a wide variety of electronic products to connect electrical components of the products together. Wire harnesses typically include a plurality of wires with connectors terminated to one end, or both ends, of the wires. The connectors terminated to the wire ends may be of either one-piece construction or multiple-piece construction in which the pieces are interlocked together to enclose the harness wires. Regardless of the style of construction of the connector, they often include male elements which are adapted to be received within a socket of corresponding female elements attached to electrical or electronic assemblies. The engagement between the male and female elements is effected by pushing the engagement ends of the male connector elements into sockets of the corresponding female elements.

A single electrical apparatus may include many mating pairs of identical connector assemblies. Accordingly, a means is provided for keying or coding such assemblies to ensure that the appropriate male element is being inserted into the appropriate female element. Such coding may be achieved by providing lugs or projections on the exterior surface of the male connector element and providing recesses on a receptacle portion of the female connector element. By removing certain lugs or projections from the male connector element and blocking the channels in the receptacle of the female connector element, keying or coding can be achieved whereby a male connector element may only be inserted into an appropriate female connector element. That is, if a male connector element is attempted to be inserted into an improper female connector element, the projections from the male connector element will not fit within a channel in the receptacle of the female connector element but rather be blocked by the plugs in the channel and thus prevent improper mating of the connector elements.

During fabrication of wire harnesses, keying or coding is achieved by removing selected ones of the coding lugs at a coding station, while other selected coding lugs which correspond to appropriate slots in the socket element are retained or the connector elements. The coding lugs are easily removed by a severing knife assembly which may contain a plurality of knife blades. The knife blades are individually indexed on the knife assembly so that individual blades may be selectively placed in or out of position for severing the coding lugs. In this manner, the knife assembly may be preset to sever the coding lugs in any predetermined pattern on one connector element or on an array of connector elements arranged in side-by-side order.

One problem occurs in the severing of these coding lugs. The coding lugs are relatively small in size compared to size of the connector elements. Therefore, the coding lugs are very susceptible to static electricity forces. It has been found that this static electricity can cause severed coding lugs to "cling" to the severing knife blades. As connector elements are serially processed in the coding station, the severed coding lugs may accumulate on the knife blades of the knife assembly to the point where they may interfere with the ability of some or all of the knife blades to properly perform their severing function. In addition, the severed lugs may become lodged within the connector elements being terminated and thus render the connector element inoperable.

The present invention is therefore directed to an assembly for use in a coding station which prevents the severed coding lugs from accumulating on the severing knife blades during operation of the knife assembly. In this regard, the present invention presents a novel wiper assembly that engages the knife blades in a manner to wipe the severed coding lugs therefrom.

Accordingly, it is an object of the present invention to provide a wire harness processing machine having an improved coding station which includes a cutoff knife wiper assembly which wipes severed coding lugs from a cutoff knife assembly.

Another object of the present invention is to provide a novel wiper assembly for use in conjunction with an electrical connector coding station wherein the coding station includes a connector advancement track, a severing knife assembly disposed in alignment with the advancement track and having a plurality of individual knife blades adapted to engage, and sever, selected coding lugs from connectors disposed in the advancement track, the wiper assembly including a wiper having a wiper arm extending proximate to the connector coding lugs and the knife blades, the wiper arm having a leading edge disposed proximate to the connector coding lugs and a trailing edge spaced apart therefrom, the leading and trailing edges defining a wiping surface in alignment with and engaging the knife blades, the leading edge of the wiper arm contacting coding lugs severed from the connector and collecting the severed coding lugs on a collection surface for removal.

It is yet another object of the present invention to provide a coding station for proceeding electrical connectors intended for use in wire harnesses, the coding station having means for holding an array of electrical connectors in place within a connector advancement track, severing means for severing selected individual coding lugs from the array of connectors, means for contacting the severing means and for collecting severed coding lugs clinging to the severing means after the coding lugs have been severed from the connector array, and pneumatic means for removing the severed coding lugs from the collecting means and expelling them to waste.

Still another object of the present invention is to provide a wiper assembly for use with a coding station, the wiper assembly including a base element, a wiper element supported by the base element and extending outwardly therefrom, the wiper element having a wiper arm aligned with a knife assembly of the coding station such that the wiper arm abuttingly engages the cutoff blades of the knife assembly during cutoff movement of the knife blades, the wiper arm having a leading edge which defines a collection surface of the wiper arm upon which severed coding lugs may accumulate, the collection surface preventing the severed coding lugs from further contact with the knife assembly cutoff blades.

SUMMARY OF THE INVENTION

In one aspect, the present invention accomplishes these objects by providing a wiper assembly with a planar wiper member which extends toward an array of connectors held in a connector advancement track. The wiper member has a first edge which is aligned with the cutoff blades of the severing knife assembly such that the first edge abuttingly engages the cutoff blades during their cutoff movement. This first edge contacts the severed coding lugs which cling to the knife blades. An interior planar surface adjacent the first edge defines a collection surface upon which the severed coding lugs may accumulate.

In another aspect of the present invention, the first edge defines a leading edge of a wiper arm. A trailing edge is spaced apart from the leading edge and the area between these two edges defines a cutoff knife contact portion of the wiper member which abuts the cutoff blades. In accordance with the preferred embodiment, the wiper member is formed from a material which is less harder than the knife blades, such as brass, so that the contact between the wiper member and the cutoff blades is more likely to result in wear on the wiper arm rather than the cutoff blades.

In yet another aspect of the present invention, the wiper member is mounted within a chamber which opens to the knife assembly and further communicates with a source of negative air pressure, such as a vacuum, in order to remove the severed coding lugs from the wiper member after accumulating on the collection surface.

These and other objects, features and advantages of the present invention will be apparent through a reading of the following detailed description, taken in conjunction with accompanying drawings, wherein like reference numerals refer to like parts.

BRIEF DESCRIPTION OF THE DRAWINGS

In the course of the description, reference will be made to the attached drawings in which:

FIG. 6 is a perspective view of a wiper assembly of the coding station of FIG. 5;

FIG. 7 is an enlarged sectional view of FIG. 5 illustrating, in greater detail, the knife-wiper interface during the initial cutoff movement of the knife assembly; and FIG. 8 is the same view as FIG. 6, but illustrating the knife-wiper interface during the retracting movement of the knife assembly.

DETAILED DESCRIPTION OF THE INVENTION

Figure 1:
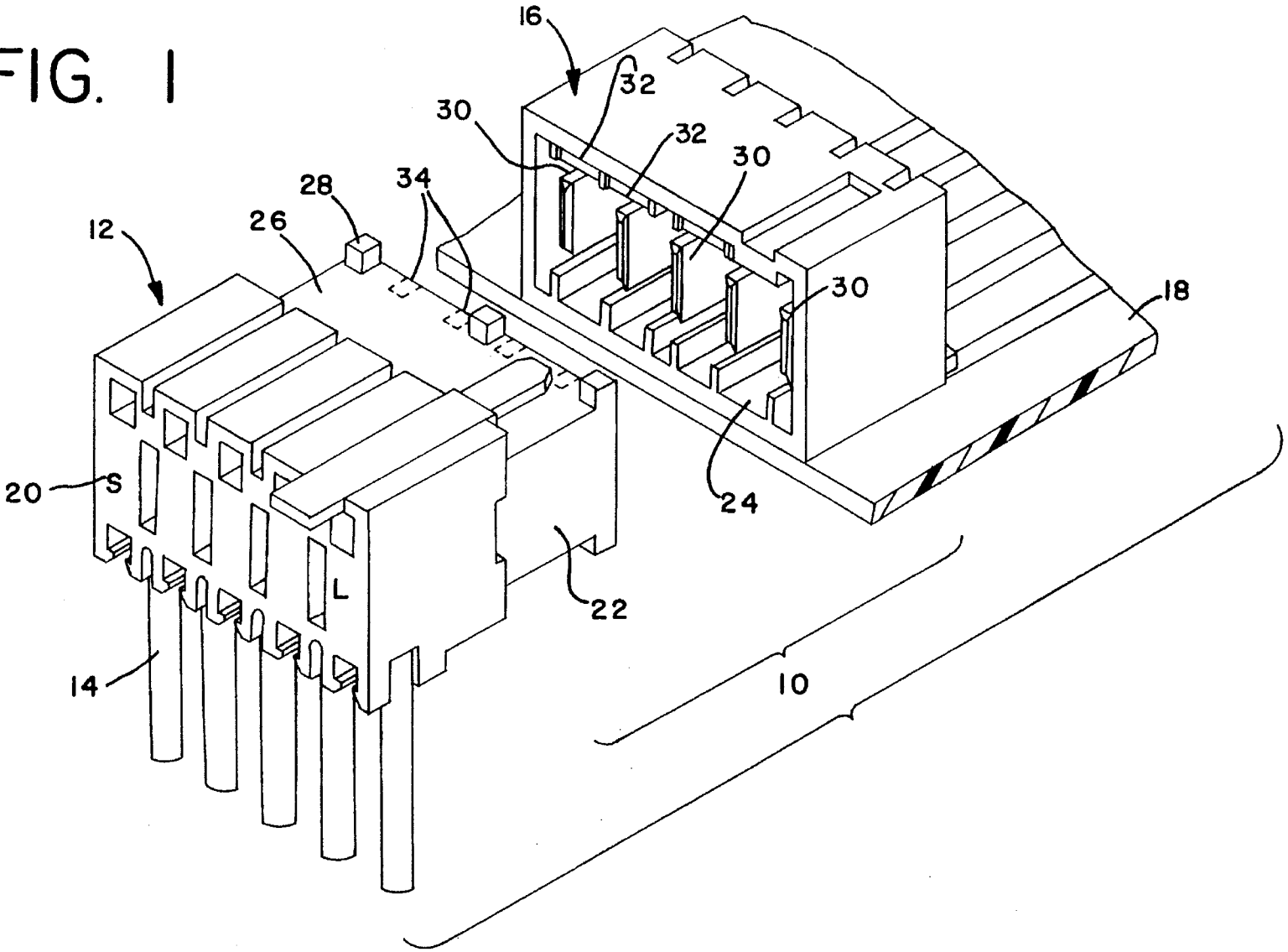
FIG. 1 is a perspective view of a mating pair of male and female connector elements processed using the present invention and illustrating the manner in which the two elements are coded.

FIG. 1 illustrates a coded connector assembly 10 having a male connector element 12 terminated to a plurality of wires 14 and a female connector element 16 attached to a circuit board 18. The connector element 12 is of a two-part construction, having two portions 20, 22, which interengage each other and which contain one or more electrical contacts (not shown) which are terminated to the wires 14 held within the connector element 12 in a conventional manner. One of the two portions, such as portion 22, serves as a male insertion member of the entire connector element 12 which is adapted to engage the female element 16 by fitting into a female opening 24 defined therein.

A single electrical apparatus may include many mating pairs of identical connector assemblies. Accordingly, a means is provided for keying or coding such assemblies to ensure that the appropriate male element is being inserted into the appropriate female element. Such coding is achieved by providing lugs or projections 28 on the exterior surface 26 of the male connector element 12.

These coding lugs 28 are received within correspondingly aligned slots 30 formed in the socket element 16. The slots 30 are spaced apart in a spacing which corresponds to the spacing between the lugs 28. The slots 30 may be closed off by suitable plug members 32 such that only a connector element 12 having coding lugs 28 corresponding to the slots 30 will be received within the socket element 16. Any connector element 12 having a coding lug pattern which does not correspond to the slot spacing of the socket element will not fit into the socket element because of the interference provided by the plug members 32.

The connector elements 12 and particularly, the male insertion members 22 are originally formed with a plurality of such coding lugs. Certain selected lugs are removed therefrom during processing of the connector elements 12 at a coding station. These coding lugs are removed by a severing knife assembly which severs selected coding lugs from the connector elements 12. The severed coding lug positions are illustrated in FIG. 1 in phantom at 34.

Figure 2:
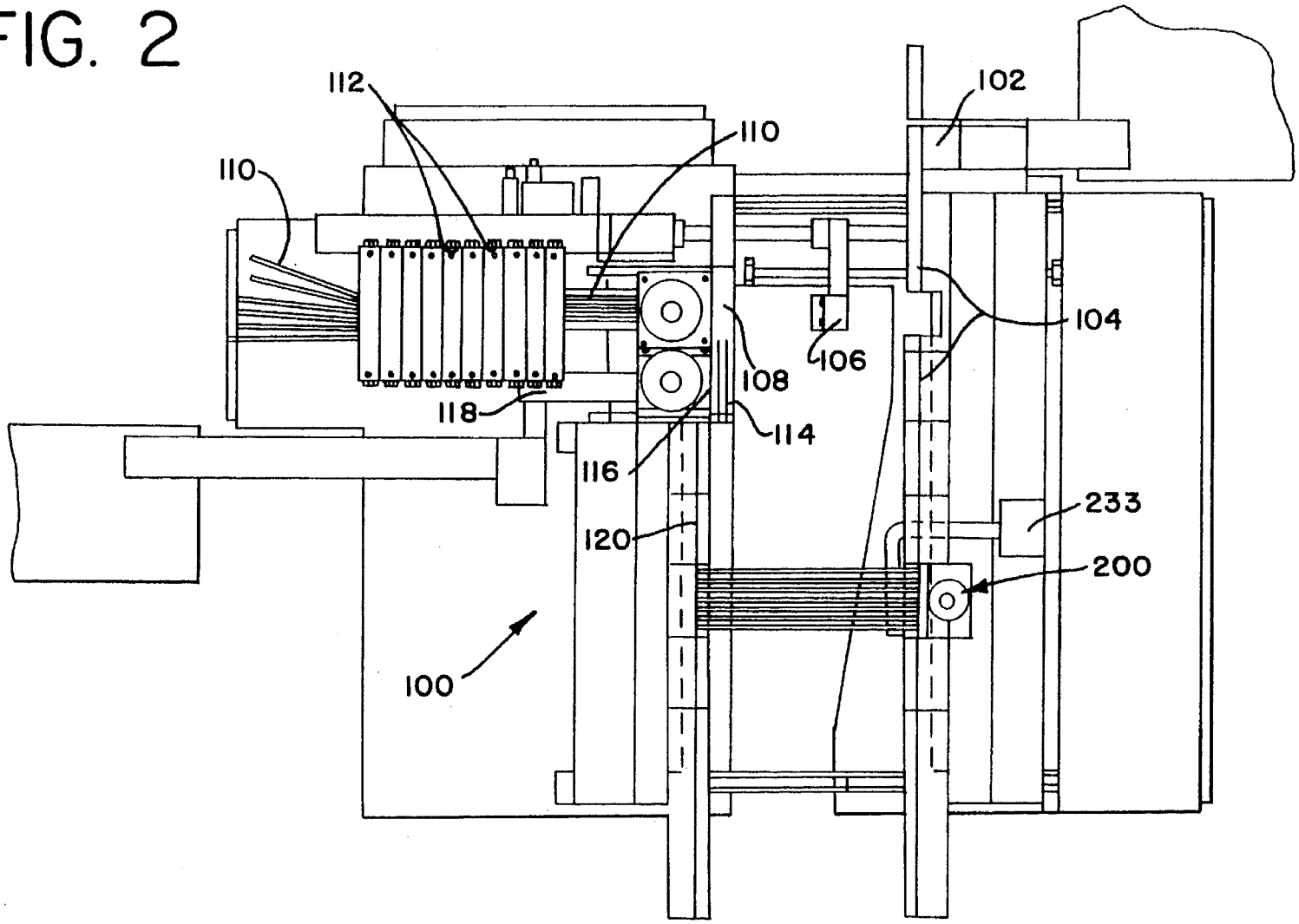
FIG. 2 is a plan view of a wire harness fabrication machine in which the present invention is used.

The coding station at which the severing of the coding lugs 28 occurs may be incorporated into an overall wire harness processing machine, such as the machine indicated at 100 in FIG. 2. In this machine, arrays of connector elements are supplied at a first connector supply station 102 into an advancement track 104 where the arrays are advanced into a connector transfer nest 106. The transfer nest 106 reciprocates between the advancement track and a first termination station 108, where a plurality of wires 110 is fed to the termination station 108 wherein the wires are inserted into the connector elements held in the transfer nest 106 and terminated thereto. Once terminated, the transfer nest 106 returns to the advancement track 104 as the wires 110 are further fed by individual wire feed motors 112 to define a predetermined length of wire for the wire harnesses.

After the wires are fed to their specified lengths, they are cut in a conventional manner and the loose ends formed by cutting are clamped in a clamping assembly 114 which reciprocates between the first termination station 108 and a second termination station 116 disposed generally adjacent thereto along the same line of the action. A second array of connector elements is supplied to the second termination station 116 by way of a second connector supply station 118. The second array of connector elements is terminated to the wire loose ends held in the clamping assembly 114 at the second termination station 116. Once terminated, the array of second connector elements is advanced along the second connector advancement track 120 while the first array of connector elements is advanced along the first connector advancement track 102 to subsequent stations where further processing of the connectors occur, such as integrity testing, coding and finishing.

Figure 3:
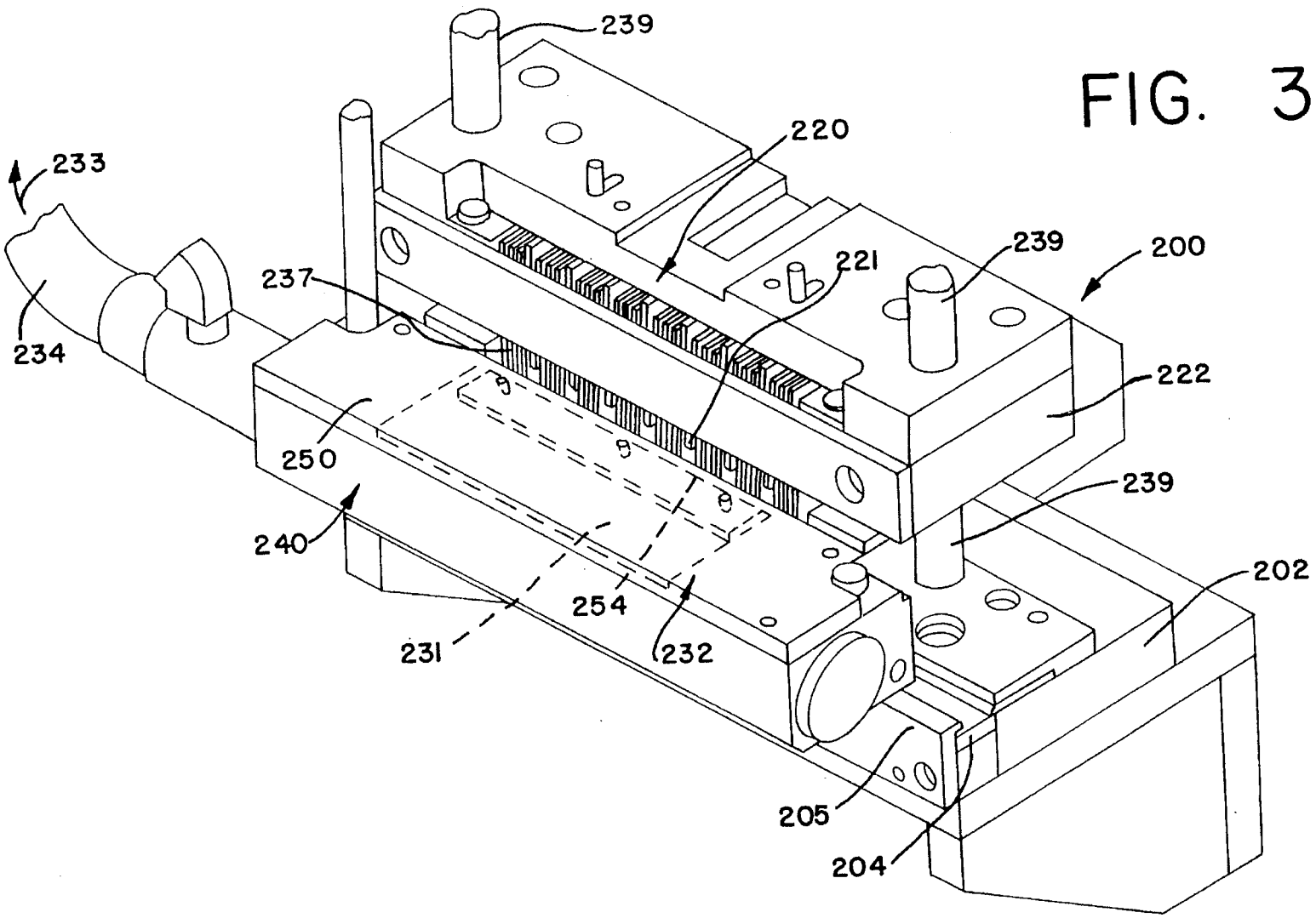
FIG. 3 is a perspective view of a coding station constructed in accordance with the principles of the present invention and used in the wire harness fabrication machine of FIG. 2.

FIG. 3 illustrates a coding station 200 suitable for use on the wire processing machine 100 and constructed in accordance with the principles of the present invention. The coding station 200 includes a base 202 having an elongated connector advancement track 204 which extends through the station 200 in alignment with a severing knife assembly 220, a waste removal assembly 240 and a wiper assembly 250. As illustrated best in FIG. 5, the track 204 includes an engagement rail 205 extending along and into the track 204 to define an engagement lip 206 which is received by a slot 302 formed in the connector element 300 generally beneath the wires 301 terminated thereto.

Figure 5:
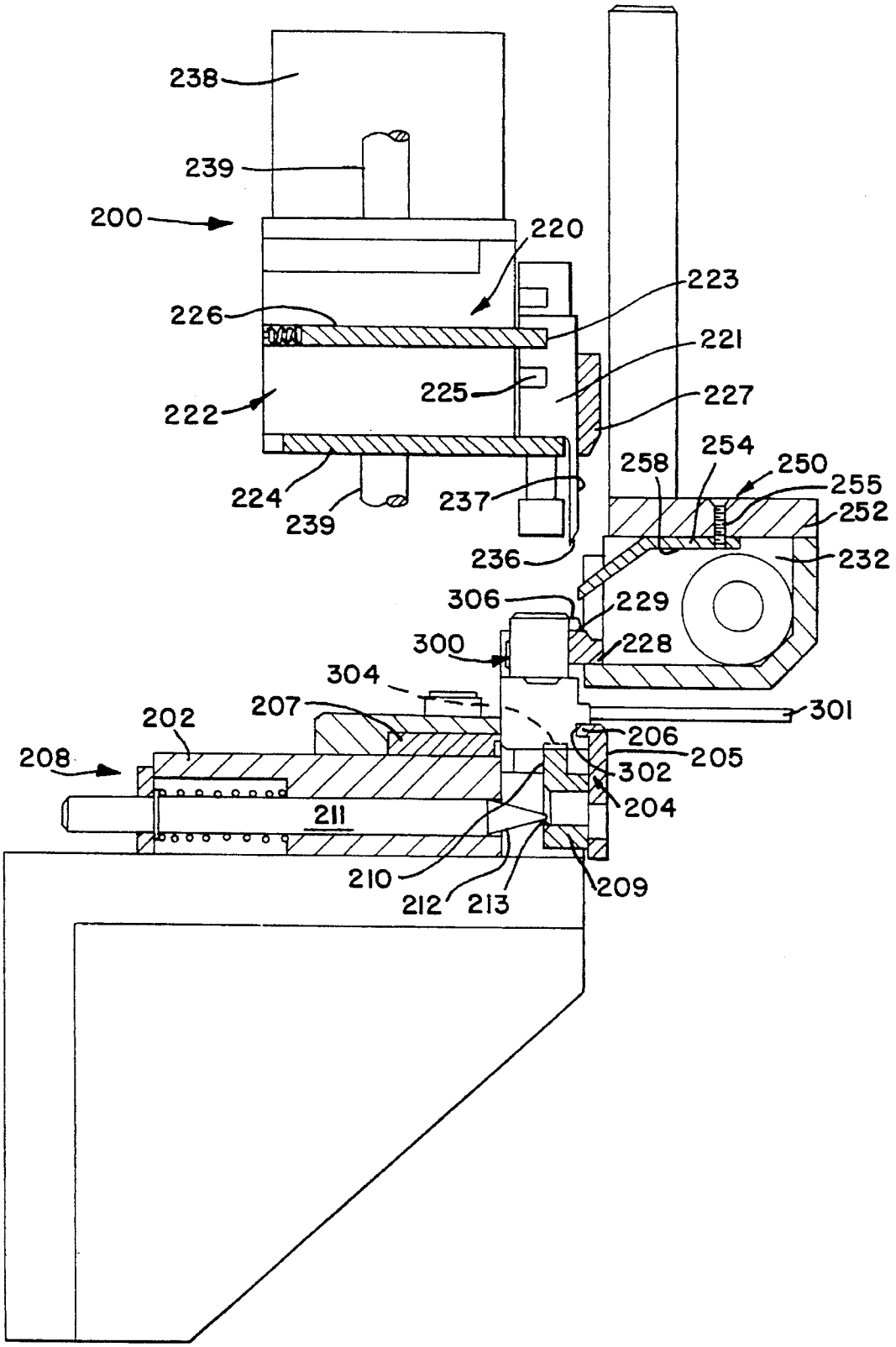
FIG. 5 is a sectional view of the coding station of FIG. 4 taken along lines 5—5 thereof.

A spring-biased pressure pad 207 may be provided in proximity to the advancement track 204 to secure the connector elements 300 in alignment within the track 204. A selectively actuatable connector element retention mechanism 208 may also be provided within the coding station 200 which includes an elongated pilot bar 209 disposed in a cavity beneath the track 204 which has a plurality of spring-loaded, upstanding engagement tabs 210 which selectively extend into the track 204. These engagement tabs 210 are selectively moved in and out of engagement with corresponding slots 304 formed in the connector elements 300 as illustrated in FIG. 5. These engagement tabs 210 are moved in and out of contact on demand by a spring-actuating pin member 211 having a forward cam surface 212 which rides upon an opposing cam surface 213 of the pilot bar 209 and urges the pilot bar engagement tabs 210 in and out of the track 204 so that they move into and out of the connector element slots 304 to respectively restrain and permit movement of the connector elements 300 in the advancement track 204 during coding.

Figure 4:
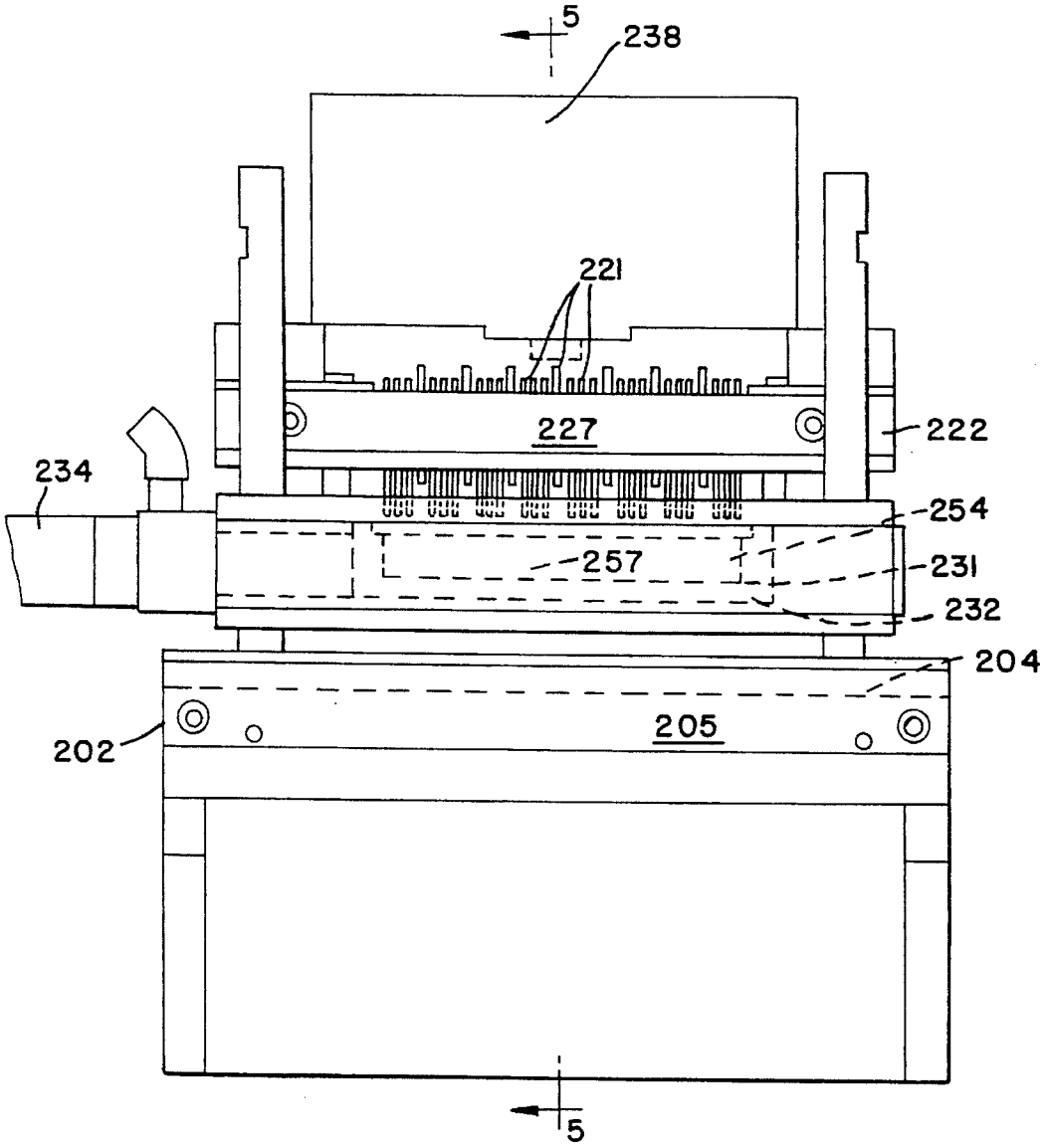
FIG. 4 is a front elevational view of the coding station of a FIG. 3.

As illustrated in FIGS. 3–5, the coding station 200 includes a severing knife assembly 220 disposed above and in alignment with the connector advancement track 204. The knife assembly 220 includes a plurality of individual, elongated, cutoff blades 221 mounted to a blade holder 222. The cutoff blades 221 may be mounted to the blade holder 222 in either a cutting position or an idle position. In the cutting position, the cutoff blades extend down from the blade holder for a distance sufficient to contact and pass through the coding lugs 306 of the connectors 300. In the idle position, the cutting blades are mounted in the blade holder 222 so that they will not contact and sever the coding lugs 306 during operation of the knife assembly.

In this regard, each cutoff blade 221 preferably has two slots 223,225 formed therein. The blades which are selected to occupy a cutting position are mounted in the blade holder so that they engage a lower retaining plate 224 of the blade holder and so the top slot 223 of the blade receives a spring-loaded blade loading plate 226 therein. The blades selected to occupy an idle position are mounted to the blade holder so that their lower slots 225 engage the loading plate 226, thereby maintaining these blades to a higher position relative to the other blades intended to perform a cutting action, such that the elevated blades will not contact the coding lugs during a severing stroke. An elongated blade cover 227 may be attached to the blade holder 222 to further retain the cutoff blades 221 in place on the holder.

The knife assembly 220 performs a reciprocating movement to effect its intended cutting action. The blade holder 222 is slidably mounted on guide rods 239 and is actuated in its reciprocating movement by a conventional means, such as a hydraulic or pneumatic cylinder 238 or the like. The reciprocating movement urges the cutoff blades between a cutoff position and a retracted position, illustrated respectively in FIGS. 7 and 8.

A cutoff anvil 228 is disposed in alignment with the cutoff blades 221 with the advancement track 204 to provide a support surface 229 against which the projecting coding lugs 306 of the connector elements 300 bear. This surface 229 also provides a reaction surface against which the cutoff blades 221 perform their severing function when in the cutoff position. The anvil 228 may be mounted to a support bracket 230 which extends along side the knife assembly 220. This support bracket 230 may include an interior recess 231 formed therein which defines a coding lug waste chamber 232 and which includes an opening 233 which communicates to an pneumatic supply means 233 by way of a supply hose 234 which may be used to supply negative or positive air pressure to the waste chamber 232 to expel severed coding lugs 306 from the waste chamber 232 to a suitable waste collection area.

A wiper assembly 250, such as that illustrated in FIG. 6, is supported near the anvil 228 overlying the waste chamber portion of the anvil mounting bracket 230. The wiper assembly 250 removes the severed coding lugs supplying from the cutoff blades 221 by "wiping" the cutoff blades 221 clean as the blades are moved to their retract position as illustrated in FIG. 8. In the embodiment illustrated, the wiper assembly 250 is seen to include a support plate 252 that extends over the waste chamber 232 and an elongated wiper member 254 secured thereto such as by screws 255.

The wiper member 254 includes two distinct planar segments 256, 257. One segment 256 serves as a planar support surface and engages the bottom surface 258 of the wiper support plate 252, while the other segment 257 extends outwardly from the one segment 256 at an angle therefrom to define a wiper arm 257 that terminates at a wiping location where the wiper arm 257 is aligned with the knife assembly 220 and the cutoff anvil 228. Preferably, the wiper arm 257 terminates above the cutoff anvil 228 at a preselected distance therefrom to define a passage therebetween that is large enough to accommodate the passage of the connector element coding lugs 306 therebetween. Preferably, the end 260 of the wiper arm 257 is formed at an angle in order to define a generally planar surface 262 which, as explained below, contacts the outer surfaces of the cutoff blades 221. In this regard, the wiper member 254 preferably has a thickness sufficient to define the planar contact surface 262 in terms of two opposing ends thereof that serve as leading and trailing edges 264, 265, respectively, of the wiper arm contact surface 262.

FIGS. 7 and 8 illustrate the manner in which the wiper assembly 250 operates. During processing, an array of connector elements 300 is advanced along the advancement track 204 until the array is in registration with the coding station 200. The actuating pin 211 is withdrawn from contact with the spring loaded pilot bar 209, so that the springs urge the engagement tabs 210 thereof upward into the connector slots 304 of the connector elements to retain the connector elements 300 in place at the coding station 200 during the coding operation. The cutoff blades 221 of the knife assembly 220 have been previously arranged by the operator such that only certain selective blades will contact and sever corresponding certain selected coding lugs 306 off of the connector elements 300.

As the cutoff blades 221 are moved downwardly in a cutting stroke to occupy their cutoff position as illustrated in FIG. 7, the leading edges 236 of selected cutoff blades 221 are brought into contact with selected coding lugs 306 generally adjacent the surface of the connector element from which they extend. As the cutting stroke continues, the leading edges 236 of the selected cutoff blades 221 pass completely through the selected coding lugs and contact the anvil surface 229 to completely sever the selected coding lugs from the connectors 300.

During this cutting stroke, the outer surfaces 237 of the cutoff blades 221 are contacted by or are immediately adjacent to the wiper arm contact surface 262. The contact which occurs between these two opposing surfaces 237, 262 is an abutting engagement wherein the wiper arm contact surface 262 rides upon the cutoff blade outer surfaces 237. As the cutting blades 221 are withdrawn in a return stroke (upwards in FIGS. 7 and 8) to occupy their retracted position, the severed coding lugs 306 which tend to cling to the cutoff blades will be contacted by the wiper arm leading edge 264 and wiped off of the cutoff blades into the waste chamber 232.

The surface 266 of the wiper arm which intersects with the leading edge 264, may serve as a partial collection surface for severed coding lugs which exhibit further static adherence proprieties to the wiper arm 257. This surface 266 is sufficiently removed from the cutoff blades 221 so as not to present an accumulation problem to the blades that might tend to interfere with the operation thereof during the cutting stroke. Also, because the wiper arm 257 is angled downwardly with respect to the support portion of the wiper member 254, the collection surface is therefore located in alignment with the air pressure supply hose 234 of the waste chamber 232. After severing has been completed, air pressure may be applied to the generally enclosed waste chamber 232 (or it may be continuously supplied) to expel the severed coding lugs to a waste location. This air pressure may be either negative air pressure in the form of a vacuum which will tend to draw the severed coding lugs through the associated supply hose 234, or positive air pressure which would be supplied to one end of the waste chamber and would force the severed coding lugs out through the supply hose 234 in the opposite end of the waste chamber 232. Preferable results have been obtained by using negative air pressure.

Because the contact surface 262 of the wiper arm 257 abuts and contacts the cutoff blades during their cutting and return strokes, it is preferred that the wiper member 254 be formed from a material that is hard enough to maintain a desirable leading edge 264 yet soft enough so as not to abrade or otherwise wear the outer surfaces 237 of the cutoff blades 221. In this regard, where the cutoff blades have been formed from steel, suitable results have been obtained by forming the wiper member from brass.

It will be appreciated that the embodiments of the present invention which have been discussed are merely illustrative of some of the applications of this invention and that numerous modifications may be made by those skilled in the art without departing from the true spirit and scope of this invention.

I claim:

1. A coding station for use in the assembly of electrical connectors to wires to form completed wire harnesses in which the connectors have coding members extending outwardly from surfaces of the connectors, the coding station comprising:

track means for receiving at least one connector therein; a knife assembly having a plurality of cutoff blades mounted thereon in a predetermined pattern and generally aligned with coding members of said at least one connector received in said track means, the knife assembly having means for moving the cutoff blades in a reciprocating movement between a cutoff position at which said cutoff blades contact and sever said coding members from said at least one connector in said track means and a retracted position wherein said cutoff blades are spaced from said at least one connector in said track means; and, a wiper assembly having a wiper arm positioned immediately adjacent to contact said cutoff blades during at least a portion of said reciprocating movement to thereby wipe severed coding members off of said cutoff blades.

2. A coding station as defined in claim 1, wherein said wiper assembly includes an angled member having first and second legs, said first leg defining a support surface for mounting said angled member at said coding station and said second leg defining said wiper arm.

3. A coding station as defined in claim 1, wherein said wiper arm is made of brass.

4. A coding station as defined in claim 2, wherein said wiper arm includes a leading edge and a trailing edge, the leading and trailing edge defining a blade contact surface therebetween, the blade contact surface being disposed generally parallel to said cutoff blades.

5. A coding station as defined in claim 1, wherein said wiper arm includes a leading edge which contacts said cutoff blades, and an elongated planar collection surface adjacent thereto.

6. A coding station as defined in claim 1, further including a waste collection chamber disposed generally adjacent said cutoff blades, said wiper arm extending into said collection chamber.

7. A coding station as defined in claim 1, further including a chamber generally adjacent said cutoff blades, said chamber defining an area for receiving coding members severed from said connectors, said coding station further including pneumatic means for supplying air pressure to said chamber to remove severed coding members therefrom.

8. A coding station as defined in claim 7, wherein said pneumatic supply means supplies negative air pressure to said chamber.

9. A coding station as defined in claim 1, wherein said wiper arm is formed from a material which is softer than a material from which said cutoff blades are formed, whereby said wiper arm will not cause any substantial wear to said cutoff blades during operation.

10. A coding station as defined in claim 1, wherein said knife assembly includes an anvil spaced apart from and aligned with said cutoff blades, such that when said cutoff blades are in said cutoff position, they contact a surface of said anvil, said anvil surface further providing support for said connector coding members during cutoff.

11. A connector coding wiper for use in an electrical connector coding station wherein selected coding members are severed from at least one electrical connector by a severing knife assembly, the knife assembly having a plurality of severing blades aligned with said connector coding members, the wiper comprising: a support member adapted to engage a mounting portion of said coding station, and a wiper member extending from said support member toward said connector and terminating proximate to said connector coding members, said wiper member having a leading edge immediately adjacent said severing knife blades as they sever coding members from said connector and preventing said severed coding members from clinging to said severing knife blades.

12. The connector coding wiper as defined in claim 11, wherein said wiper member includes an elongated planar portion which defines a coding member collection surface adjacent said leading edge.

13. The connector coding wiper as defined in claim 11, wherein said wiper member further includes a trailing edge spaced apart from said leading edge, said leading and trailing edges cooperating to define an elongated severing knife blade contact surface extending between said leading and trailing edges, said severing knife blade contact surface being generally parallel to said severing knife blades.

14. The connector coding wiper as defined in claim 11, wherein said wiper member is formed from brass.

15. An improved wire harness processing machine having means for feeding electrical connectors to two termination stations and terminating the electrical connectors to opposite ends of a plurality of wires to produce wire harnesses in serial order, the electrical connectors of the wire harnesses being of the type having a plurality of coding elements extending therefrom, the machine further having a coding station which removes selected ones of the coding elements from said electrical connectors by moving a knife assembly having a plurality of cutoff blades aligned with said selected coding elements into and out of contact with said selected coding elements to sever said selected coding elements from said connectors, the improvement comprising: means for wiping said severed selected coding elements from said cutoff blades.

16. The wire harness processing machine as defined in claim 15, wherein said wiping means includes an elongated planar wiper arm, the wiper arm having a leading edge which contacts said cutoff blades and which defines an elongated contact surface on one side of said leading edge and an elongated collection surface on an opposite side of said leading edge.

17. The wire harness processing machine as defined in claim 16, wherein said wiper arm contact surface is generally parallel to said cutoff blades.

18. The wire harness processing machine as defined in claim 15, wherein said wiping means includes an angled wiper member having two wiper legs, one of said wiper legs providing a support surface for mounting to said coding station and the other of said wiper lugs providing a wiper arm which extends from said support surface toward said cutoff blades into a position within said coding station generally above said connector coding elements, said wiper arm further abutting said cutoff blades when said cutoff blades contact said selected coding elements, whereby said wiper arm wipes said severed coding elements from said cutoff blades.

19. The wire harness processing machine of claim 18, wherein said wiper arm has a leading edge which defines a cutoff wiper arm-blade contact surface.

* * * * *